US011905956B2

(12) United States Patent
Pippes

(10) Patent No.: US 11,905,956 B2
(45) Date of Patent: Feb. 20, 2024

(54) INTERNAL GEAR MACHINE WITH SWITCHING VALVES

(71) Applicant: HYDRAULIK NORD TECHNOLOGIES GMBH, Parchim (DE)

(72) Inventor: Thomas Pippes, Pinnow (DE)

(73) Assignee: HYDRAULIK NORD TECHNOLOGIES GMBH, Parchim (DE)

( * ) Notice: Subject to any disclaimer, the term of this patent is extended or adjusted under 35 U.S.C. 154(b) by 0 days.

(21) Appl. No.: 17/996,031

(22) PCT Filed: Mar. 18, 2021

(86) PCT No.: PCT/EP2021/056926
§ 371 (c)(1),
(2) Date: Oct. 12, 2022

(87) PCT Pub. No.: WO2021/209222
PCT Pub. Date: Oct. 21, 2021

(65) Prior Publication Data

US 2023/0193899 A1 Jun. 22, 2023

(30) Foreign Application Priority Data

Apr. 14, 2020 (DE) ..... 10 2020 110 217.8

(51) Int. Cl.
*F04C 2/10* (2006.01)
*F04C 14/04* (2006.01)
*F04C 15/06* (2006.01)

(52) U.S. Cl.
CPC ..... *F04C 2/101* (2013.01); *F04C 14/04* (2013.01); *F04C 15/064* (2013.01)

(58) Field of Classification Search
CPC ..... F04C 2/101; F04C 14/04; F04C 15/064
See application file for complete search history.

(56) References Cited

U.S. PATENT DOCUMENTS 2,420,622 A 5/1947 Roth
5,197,869 A * 3/1993 Hansen ..... F04C 2/101 418/104

(Continued)

FOREIGN PATENT DOCUMENTS

DE 19503943 A1 9/1995
DE 4338875 C2 11/2003

(Continued)

OTHER PUBLICATIONS

Machine Translation and Foreign Patent DE-102007022216-A1, Inventor: Noack, Title: Hydraulic System with Gear Pump, Published: Nov. 13, 2008. (Year: 2008).*

(Continued)

*Primary Examiner* — Mary Davis
(74) *Attorney, Agent, or Firm* — Norris McLaughlin, P.A.

(57) ABSTRACT

The application relates to an internal gear machine for reversing duty having a housing with a chamber, in the chamber there are disposed an externally toothed pinion and an internally toothed ring gear, which mesh with one another, the rotational axes of which run parallel to and spaced apart from one another. The chamber in the housing is axially bounded and is connected via pressure pockets provided in the housing to pressure connections in the internal gear machine. According to the invention, a switching valve is arranged in each connection between the pressure pockets and the pressure connections or compression spaces, which valve opens or closes the connection.

7 Claims, 4 Drawing Sheets

(56) References Cited

U.S. PATENT DOCUMENTS

| | | | | |
|---|---|---|---|---|
| 5,333,451 | A | 8/1994 | Sakikawa et al. | |
| 6,419,471 | B1 | 7/2002 | Arbogast et al. | |
| 9,945,377 | B2 * | 4/2018 | Pippes | F04C 2/101 |
| 2010/0322810 | A1 | 12/2010 | Schepp et al. | |
| 2020/0109709 | A1 | 4/2020 | Osaki et al. | |

FOREIGN PATENT DOCUMENTS

| | | | |
|---|---|---|---|
| DE | 102008053318 | A1 | 4/2010 |
| DE | 102011016309 | A1 | 10/2012 |
| DE | 102011100105 | A1 | 10/2012 |
| EP | 1110000 | B1 | 6/2001 |
| GB | 489955 | A | 8/1938 |
| WO | 2018/172059 | A1 | 9/2018 |

OTHER PUBLICATIONS

International Search Report dated Aug. 2, 2021, in connection with PCT International Application No. PCT/EP2021/056926.
English translation of International Search Report dated Aug. 2, 2021, in connection with PCT International Application No. PCT/EP2021/056926.
Written Opinion issued in connection with PCT International Application No. PCT/EP2021/056926.

* cited by examiner

INTERNAL GEAR MACHINE WITH SWITCHING VALVES

This application is the U.S. National Stage of International Application No. PCT/EP2021/056926, filed 18 Mar. 2021, which claims foreign priority benefit under 35 U.S.C. § 119 of German Patent Application No. 10 2020 110 217.8, filed 14 Apr. 2020, the disclosures of which are incorporated herein by reference.

The invention relates to an internal gear machine for reversing operations as set forth hereinafter.

Internal gear machines of the generic type are known. For example, WO 2018/172059 A1, EP 1 110 000 B1 and DE 43 38 875 C2 each disclose internal gear machines for reversing operations in which, in a chamber of a housing, an externally toothed pinion and an internally toothed ring gear are disposed in such a way that they mesh with one another. The rotational axes of the internal pinion and of the ring gear are arranged parallel to and spaced apart from one another so that these are eccentric to one another. A filling piece is arranged in a sickle-shaped chamber resulting between the pinion and the ring gear. Furthermore, the chamber in the housing is axially limited. The housing has fluid connections which are connected to pressure pockets provided in the housing.

Such reversable internal gear machines can consequently be deployed as a pump in both directions of rotation of the driven pinion. Furthermore, so-called four-quadrant operation is also possible, that is to say, by supplying one of the pressure connections in the internal gear machine with a fluid, the latter can also be operated as a hydraulic motor. In this case, alternating operation is likewise possible.

Internal gear machines for the high-pressure range have a so-called hydrostatic ring gear bearing. Ring gear play caused by the design results in leakage of the medium to be conveyed, generally g oil, for example hydraulic oil. In a zero-crossing when changing the direction of force of the ring gear, that is switching over the pump direction or switching over the drive direction, pressurization of both sides of the bearing can take place simultaneously. This is likewise possible during external pressurization in multi-range operation, i.e. an inlet pressure acts at the pump inlet. This leads to increased leakage in the ring gear bearing since the ring gear can only seal one side of the ring gear bearing.

The object which forms the basis of the invention is to create an internal gear machine of the generic type, in which a leakage in the ring gear bearing is minimized in a simple manner during the zero-crossing or during pressurization of both sides.

According to the invention, this object is achieved by an internal gear machine having the features set forth herein. The fact that a switching valve is arranged in each connection between the pressure pocket and the pressure connection, i.e. in both connections between the pressure pocket and pressure connection per bearing side, said valve opening or closing the connection depending on the pressure, means that it is advantageously possible to control the internal gear machine such that only one pressure pocket is always supplied with pressure. As a result, the hydrostatic ring gear bearing can be very advantageously switched over to a hydrodynamic ring gear bearing. A leakage between the two pressure sides, in particular during a zero-crossing or pressurization of both sides, can consequently be avoided, since a pressurization of both sides of the ring gear bearing is avoided.

In a preferred configuration of the invention, it is provided that the switching valves are hydraulically spring-loaded two-position valves. Consequently, the switchover function between the hydrostatic ring gear bearing and hydrodynamic ring gear bearing can be simply integrated into the internal gear machine.

In a further preferred configuration of the invention, it is provided that a spring side of a first switching valve is connected to a second pressure connection of the internal gear machine and a spring side of a second switching valve is connected to a first pressure connection of the internal gear machine. This alternating pressure linkage ensures, in a simple manner, that the connection between the pressure pocket and the pressure connection can be opened or closed in a simple and secure manner via the pressure applied in each case to the other pressure connection. The switchover between the hydrostatic ring gear bearing and the hydrodynamic ring gear bearing is thus possible in a particularly simple manner.

Moreover, it is provided in a preferred configuration of the invention that the switching sides of the switching valves are connected to the pressure connection of the internal gear machine assigned to the respective switching valve. Thus, the pressure difference between the two pressure connections in the internal gear machine can be applied to the switching valves arranged in the connections between the pressure pockets and pressure connection in a simple manner by providing appropriate control channels in the housing.

Furthermore, it is provided in a preferred configuration of the invention that an opening pressure of the switching valves can be adjusted via a preload of switching springs of the switching valves. As a result, the opening pressure can be realized in a simple manner by dimensioning the switching springs which consequently determine the differential pressure between the pressure connections, at which the switching valves close or open.

Finally, it is provided in a further preferred configuration of the invention that an opening pressure of the switching valves is <30 bar, in particular <20 bar. Consequently, the ring gear bearing can be switched over very precisely and quickly from the hydrostatic to the hydrodynamic state. The internal gear machine can consequently also be operated when high pressure of, for example, >300 bar is applied to the pressure connections, without significant leakage or with no leakage.

According to a further preferred configuration, according to a further exemplary embodiment which is not depicted, the switching valves can also be activated electromagnetically. The pressures applied to the internal gear machine are then converted by means of a control device into control signals which serve to activate corresponding switching magnets of the switching valves.

Further preferred configurations of the invention are set forth herein.

The invention is explained in greater detail below in an exemplary embodiment with reference to the accompanying drawings, wherein.

Figure 1:
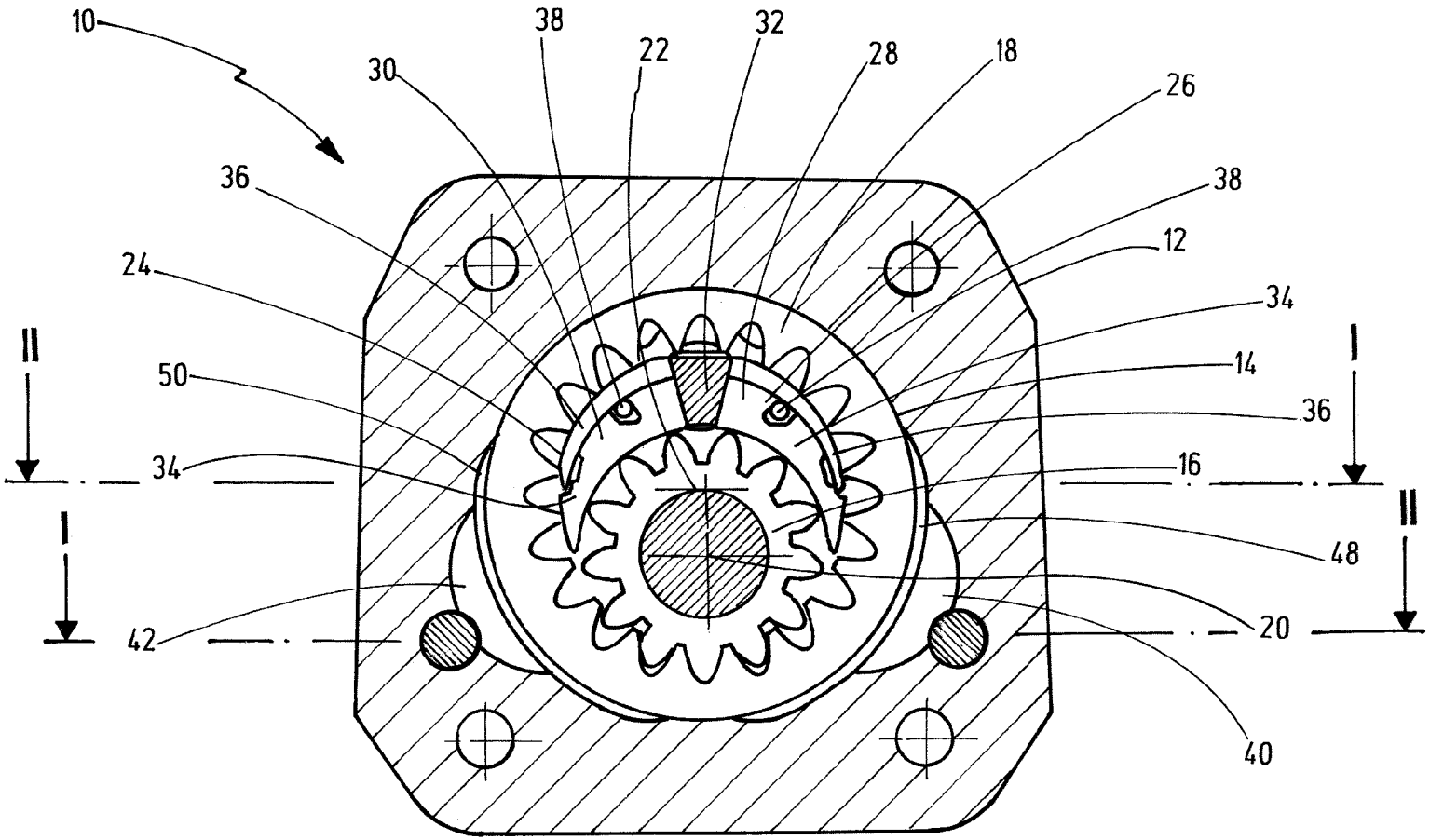
FIG. 1 shows a sectional view of an internal gear machine.

FIG. 1 shows a sectional view of an internal gear machine designated as a whole with 10. The internal gear machine 10 is configured for so-called reversing operations, that is to say the latter can be operated as a pump in both directions of rotation. The internal gear machine 10 can also be operated in so-called four-quadrant operation.

The internal gear machine 10 has a housing 12, inside which a chamber 14 is configured. In the chamber 14, an externally toothed pinion 16 and an internally toothed ring gear 18 are disposed. The pinion 16 is rotatably arranged about a longitudinal axis 20 and the ring gear 18 is rotatably arranged about a longitudinal axis 22. The longitudinal axes 20 and 22 consequently form rotational axes, on the one hand, for the pinion 16 and, on the other hand, for the ring gear 18. The rotational axes are arranged parallel to and spaced apart from one another. The pinion 16 and ring gear 18 are arranged so that these mesh with one another with their external toothing or internal toothing.

A filling piece 26 is arranged inside a sickle-shaped free space 24 resulting between the pinion 16 and the ring gear 18. The filling piece 26 has two filling piece parts 28 and 30 which are arranged on both sides of a stop pin 32. These filling piece parts 28 and 30 each consist of inner sealing segments 34 and outer sealing segments 36. The gap between the inner sealing segments 34 and the outer sealing segments 36 is sealed by sealing rollers 38.

Furthermore, pressure pockets 40 and 42, which are each connected to a fluid connection 44 or fluid connection 46 of the internal gear machine 10, are located in the housing. The pressure pockets 40 and 42 and, consequently, the fluid connections 44 and 46 are connected to the chamber 14 via the control geometries 48 and 50.

The construction and method of operation of such an internal gear machine 10 are sufficiently known to the person skilled in the art, such that a more detailed description is dispensed with at this point. Reference is also made here, for example, to the prior art cited at the beginning.

Figure 2:
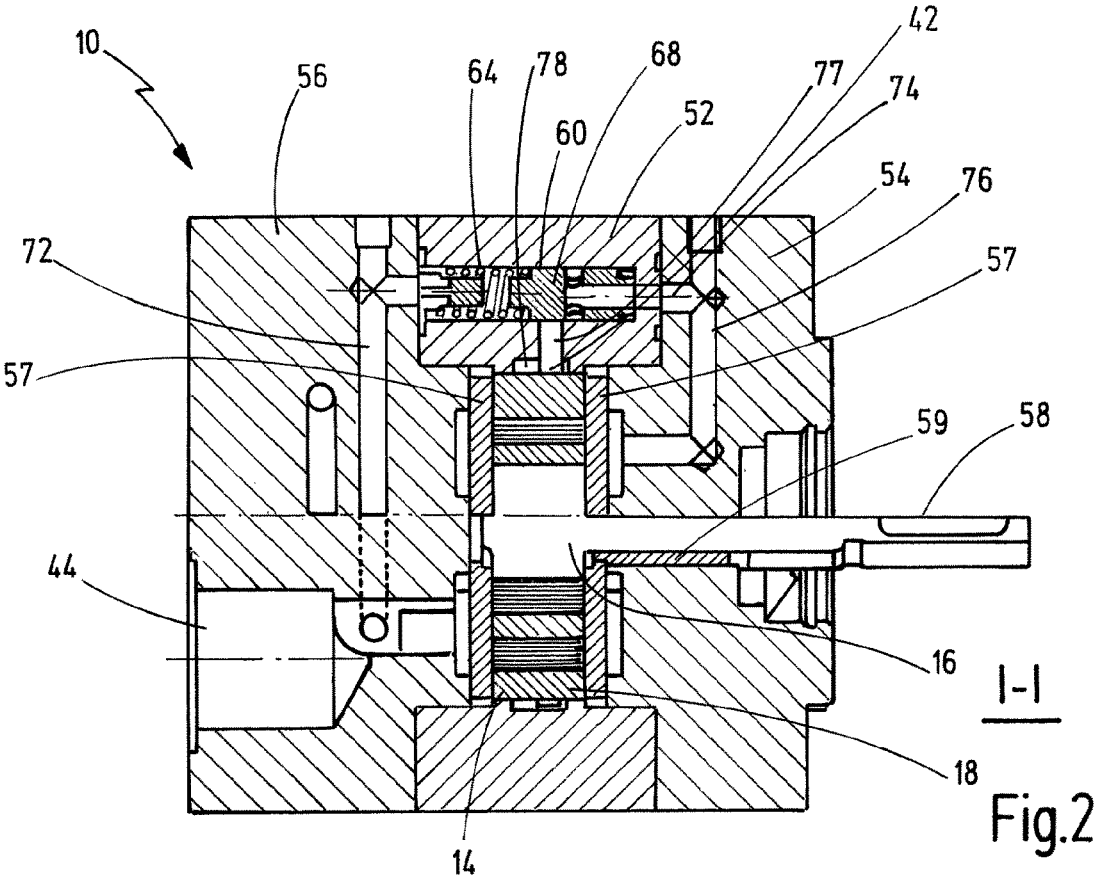
FIGS. 2 and 3 show a sectional view of the internal gear machine according to sectional line I-I or sectional line II-II in FIG. 1.
Figure 3:
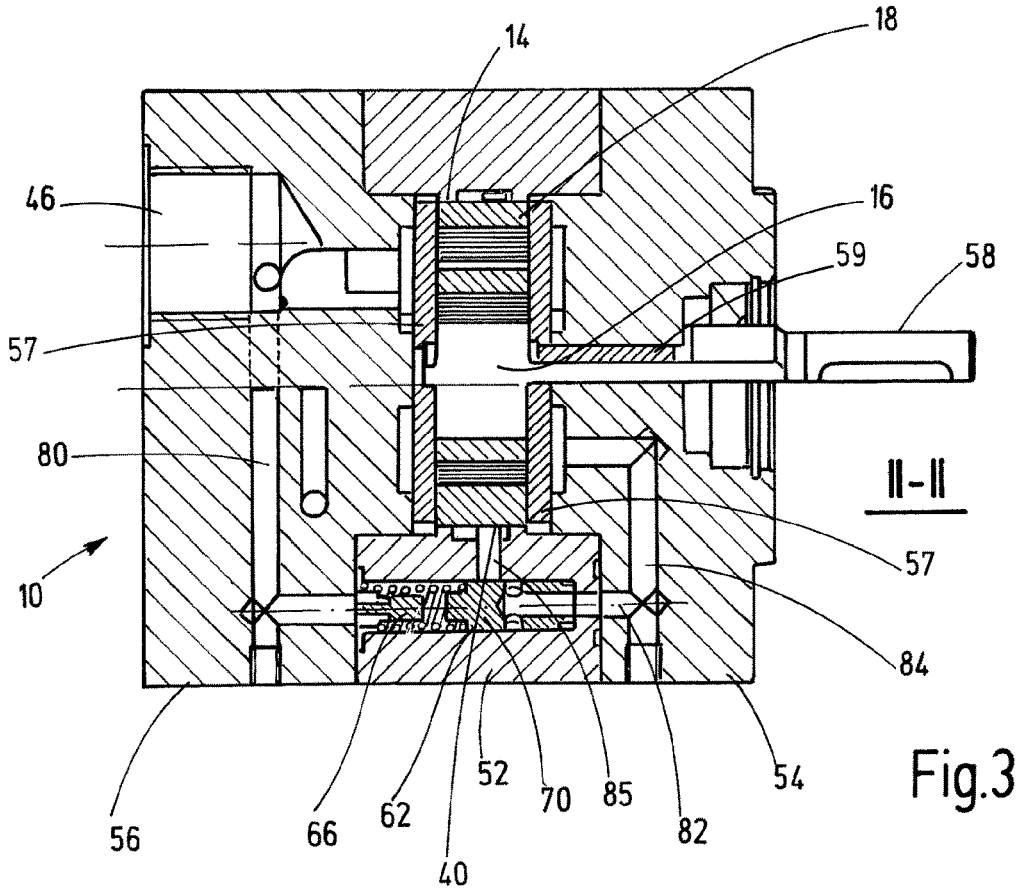

Sectional representations are shown in a stepped section through several planes through the internal gear machine 10 along the sectional lines I-I or II-II in each of FIGS. 2 and 3.

On the basis of FIGS. 2 and 3, it is made clear that the housing 12 is configured in three parts and consists of a housing ring 52 as well as a flange cover 54 or connection cover 56. The housing ring 52 hereby encloses the chamber 14, in which the pinion 16 and ring gear 18 as well as the filling piece 26 are arranged. The pinion 16 is connected to a shaft 58 which is guided in a sealing manner through the flange cover 54, which shaft, depending on the operating mode in the internal gear machine, acts as a drive shaft or an output shaft. The shaft 58 is preferably hydrodynamically supported by bearing bushes 59.

The chamber 14 is axially sealed by axial pressure plates 57 which are arranged in the axial direction between the ring gear 18 and the connection cover 56 or flange cover 54.

FIG. 2 makes it clear that a switching valve 60 assigned to the pressure pocket 42 and a switching valve 62 assigned to the pressure pocket 40 are integrated inside the housing 12. In the example shown, the switching valves 60 and 62 are provided inside the housing ring 52.

The switching valves 60 and 62 are hydraulically spring-loaded two-position valves.

The switching valves 60 and 62 comprise a control piston 68 or 70 which can be moved against the force of a spring element 64 or 66 inside a chamber.

The spring side of the control piston 68 of the switching valve 60 is connected via a connection 72 to the pressure connection 44 and, consequently, to the fluid connection 44. On its switching side, the switching valve 60 is connected to the pressure connection 46 via a connection 74. This connection is effected via a further connection 76 which connects the switching valve 60 to the displacement space 78 assigned to the pressure pocket 42 and, consequently, also the pressure connection 46 of the internal gear machine 10. A further connection 77 connects the switching valve 60 to the pressure pocket 42.

In a completely analogous manner, the spring side of the switching valve 62 is connected to the pressure connection 46 via a connection 80. The switching side of the switching valve 62 is connected to the pressure connection 44 via a connection 82. The switching valve 62 is connected via a connection 84 to a displacement space 86 of the internal gear machine 10 assigned to the pressure connection 44. A further connection 85 connects the switching valve 62 to the pressure pocket 40.

Figure 4:
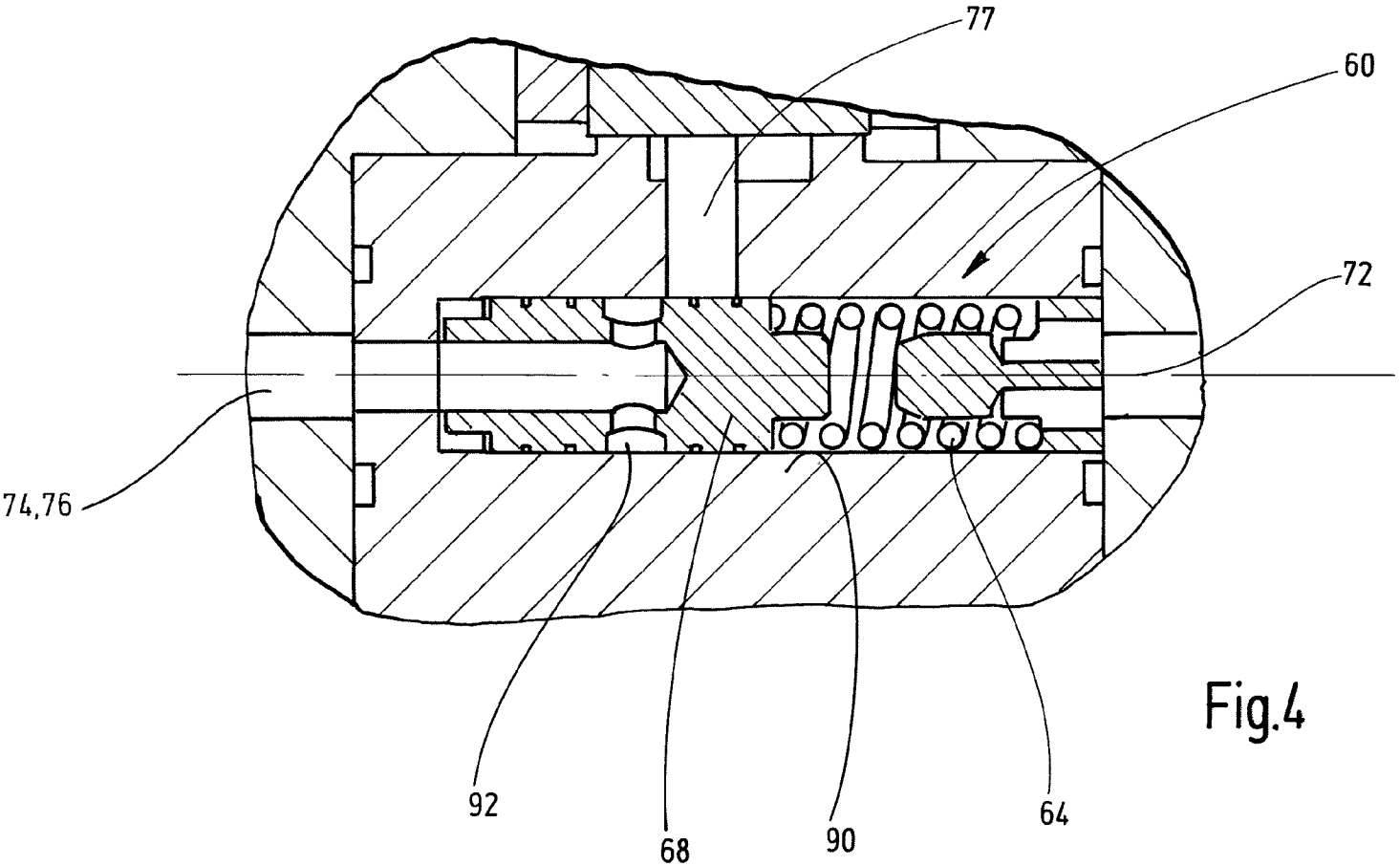
FIG. 4 shows an enlarged representation of a switching valve.

On the basis of the enlarged representation of the switching valve 60 in FIG. 4, it is made clear that the control piston 68 is displaceably guided in a sealing manner against the force of the spring element 64 inside an internal space 90. On the spring side, the connection 72 opens out, and on the opposite switching side, the connection 74 opens out into the internal space 90. Furthermore, the connection 77 opens out into the internal space 90, which connection is sealed by the control piston 68 in the representation shown.

As a rule, if the pressure applied to the connection 74 exceeds the pressure applied to the connection 72 plus the compressive force of the spring 64, the control piston 68 is moved to the right in the plane of the paper in accordance with the representation in FIG. 4. As a result, a continuous connection is established between the connections 74 and 77 via passages 92 inside the control piston 68. The switching valve 60 consequently switches from its blocking position shown in FIG. 4 into the open position. There is then a continuous connection between the pressure pocket 42 and the pressure connection 46 and, consequently, the displacement space 78.

Figure 5:
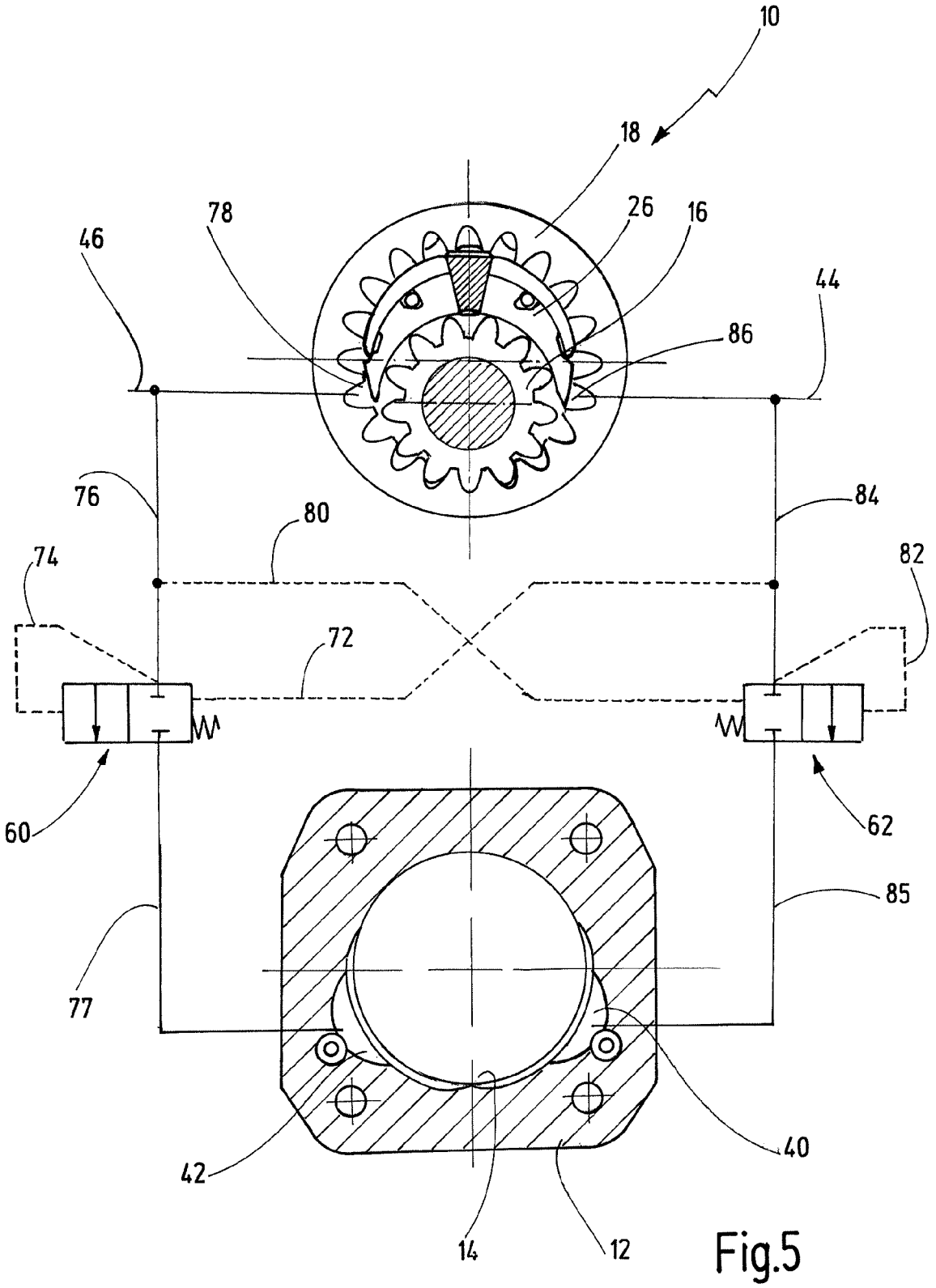
FIG. 5 shows a schematic circuit diagram of the internal gear machine according to the invention.

On the basis of the schematic representation of the internal gear machine 10 shown in FIG. 5, the overall function of the arrangement of the additional switching valves 60 and 62 provided according to the invention is illustrated.

A switching valve is assigned to each pressure pocket; here, switching valve 62 is assigned to pressure pocket 40 and switching valve 60 is assigned to pressure pocket 42. Here, the respective spring side of the switching valves 60 or 62 is connected via the connection 72 or 80 to the respectively opposite displacement space 86 or 78.

The switching side of the switching valves 60 or 62 is connected via the connections 74/76 or connections 82/84 to the displacement space 78 or 86 on the same side.

The preload of the springs corresponds to an opening pressure of approximately 20 bar.

Both switching valves 60 and 62 are shown in their closed position in FIG. 5. In this case, there is a pressure difference between the applied pressures in the displacement spaces 86 and 78 which is less than the opening pressure of the switching valves 60 or 62, which is, for example, approximately 20 bar. The two pressure pockets 42 and 40 are consequently not supplied with pressure due to the closed position of the switching valves 60 and 62. The ring gear 18 is consequently supported hydrodynamically.

If the pressure difference between the displacement spaces 78 and 86 increases above the opening pressure of the switching valve 60 or the switching valve 62, the respective switching valve 60 or 62 is switched to its open position. In this case, a connection is created between the respective displacement space 78 and the switching pocket 42 or in the displacement space 86 and the switching pocket 40. This means that the switching pocket 42 or the switching pocket 40 is supplied with the higher displacement pressure in the assigned displacement space 78 or 86. At this moment, the ring gear 18 is hydrostatically supported.

REFERENCE NUMERALS

10 Internal gear machine
12 Housing
14 Chamber
16 Pinion
18 Ring gear
20 Longitudinal axis
22 Longitudinal axis
24 Sickle-shaped free space
26 Filling piece
28 Filling piece part
30 Filling piece part
32 Stop pin
34 Inner sealing segment
36 Outer sealing segment
38 Sealing roller
40 Pressure pocket
42 Pressure pocket
44 Fluid connection
46 Fluid connection
48 Control geometry
50 Control geometry
52 Housing ring
54 Flange cover
56 Connection cover
57 Axial pressure plate
58 Shaft
59 Bearing bush
60 Switching valve
62 Switching valve
64 Spring element
66 Spring element
68 Control piston
70 Control piston
72 Connection
74 Connection
76 Connection
77 Connection
78 Displacement space
80 Connection
82 Connection
84 Connection
85 Connection
86 Displacement space
90 Internal space
92 Passages

The invention claimed is:

1. An internal gear machine for reversing operations, having a housing with a chamber, wherein, in the chamber, an externally toothed pinion and an internally toothed ring gear are disposed which mesh with one another, the rotational axes of which run parallel to and spaced apart from one another, wherein the chamber of the housing is axially limited, wherein, in the housing, a first pressure pocket and a second pressure pocket are located which are connected to the chamber, wherein the first pressure pocket is connected to a first pressure connection and the second pressure pocket is connected to a second pressure connection of the internal gear machine, wherein a second switching valve is arranged in the connection between the first pressure pocket and the first pressure connection and a first switching valve is arranged in the connection between the second pressure pocket and the second pressure connection, and the first pressure connection is connected to a first displacement chamber of the internal gear machine and the second pressure connection is connected to a second displacement chamber of the internal gear machine.

2. The internal gear machine according to claim 1, wherein the first and second switching valves are hydraulically spring-loaded two-position valves.

3. The internal gear according to claim 1, wherein a spring side of the first switching valve is connected to the second pressure connection of the internal gear machine.

4. The internal gear machine according to claim 1, wherein a spring side of the second switching valve is connected to the first a pressure connection of the internal gear machine.

5. The internal gear machine according to claim 1, wherein the switching sides of the first and second switching valves are connected to the pressure connection of the internal gear machine assigned to the respective switching valve.

6. The internal gear machine according to claim 1, wherein an opening pressure of the first and second switching valves can be adjusted via a preload of a switching spring of the first and second switching valves.

7. The internal gear machine according to claim 1, wherein the opening pressure of the first and second switching valves is <30 bar.

* * * * *